US006148525A

United States Patent [19]

Mizutani et al.

[11] Patent Number: 6,148,525

[45] **Date of Patent: *Nov. 21, 2000**

[54] CHAIN TENSION DEVICE IN A CHAIN SAW

[75] Inventors: Makoto Mizutani; Hideki Abe, both of Anjo, Japan

[73] Assignee: Makita Corporation, Anjo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/950,209

[22] Filed: Oct. 14, 1997

[30] Foreign Application Priority Data

Oct. 24, 1996 [JP] Japan ..... 8-322095

[51] Int. Cl.[7] ..... B27B 17/14

[52] U.S. Cl. ..... 30/386; 30/383

[58] Field of Search ..... 30/386, 383, 385; 83/814, 816

[56] References Cited

U.S. PATENT DOCUMENTS

| | | | |
|---|---|---|---|
| 3,636,995 | 1/1972 | Newman | 143/32 J |
| 4,382,334 | 5/1983 | Reynolds | 30/386 |
| 4,567,658 | 2/1986 | Wissmann et al. . | |
| 4,835,868 | 6/1989 | Nagashima . | |
| 4,920,650 | 5/1990 | Edlund . | |
| 5,070,618 | 12/1991 | Edlund | 30/386 |
| 5,144,751 | 9/1992 | Weber . | |
| 5,345,686 | 9/1994 | Zimmermann | 30/386 |
| 5,353,506 | 10/1994 | Muller et al. | 30/386 |
| 5,528,835 | 6/1996 | Ra | 30/386 |

FOREIGN PATENT DOCUMENTS 6193201 of 0000 Japan .

*Primary Examiner*—M. Rachuba
*Attorney, Agent, or Firm*—Davis and Bujold

[57] ABSTRACT

A chain tension device for tensioning a cutting chain of a chain saw utilizing a guide bar having an outer periphery and a drive sprocket. The chain saw body supports the guide bar, the sprocket and a drive source. A cutting chain is wound around the sprocket and the outer periphery of the guide bar and a leaf spring is supported by the chain saw body and interposed between the guide bar and the sprocket. The leaf spring abuts and biases the guide bar away from the sprocket so as to apply automatically an appropriate amount of tension to the cutting chain.

16 Claims, 4 Drawing Sheets

CHAIN TENSION DEVICE IN A CHAIN SAW

BACKGROUND OF THE INVENTION

The present invention relates to a tension device of a chain in a chain saw.

In a conventional chain tension device mounted on a chain saw, adjustment screws are provided parallel with a longitudinal guide bar, and the tension of a chain is adjusted by loosening or tightening the adjustment screws to move the guide bar. In another chain tension device, as proposed in the Japanese Utility Model Application laid-open No. Sho 61-93201, a rod member is disposed along a chain tensioning direction, engaged with a guide bar, and biased by a compression spring in the chain tensioning direction, so that the tension of a chain is properly adjusted.

In the former chain tension device, however, the adjustment screws need to be laboriously loosened or tightened in the guide bar with a screw driver or the like. Further, it is difficult to properly adjust the tension of the chain without applying excessive or insufficient tension to the chain. In the latter chain tension device, since the rod member is provided in the longitudinal direction, the number of components is increased, a compact structure cannot be obtained, and the attachment of the rod member itself is laborious.

SUMMARY OF THE INVENTION

Wherefore, an object of the invention is to provide a chain tension device for use in a chain saw which can properly adjust the tension of a chain, has a simple and compact structure, and can be easily mounted on the chain saw.

To attain this or other objects, the invention provides a chain tension device for adjusting the tension of a chain, driven by a sprocket, by moving a guide bar having the chain wound around the outer periphery thereof. A chain saw body is provided with a leaf spring for biasing the guide bar in a chain tensioning direction.

According to the invention, when the guide bar is released from its fixed position, the guide bar is biased in the chain tensioning direction by the resilient force of the leaf spring, so that the tension of the chain can be properly adjusted without applying excessive or insufficient tension to the chain. Further, the chain tension device has a simple and compact structure, and can be easily mounted on the chain saw.

Also in the chain tension device of the invention, the leaf spring abuts against the substantially rear middle part of the guide bar.

According to the invention, since the guide bar can be securely moved in the longitudinal direction, without causing any vertical dislocation, the tension of the chain can be properly adjusted.

DETAILED DESCRIPTION OF THE PREFERRED EMBODIMENT(S)

Figure 1:
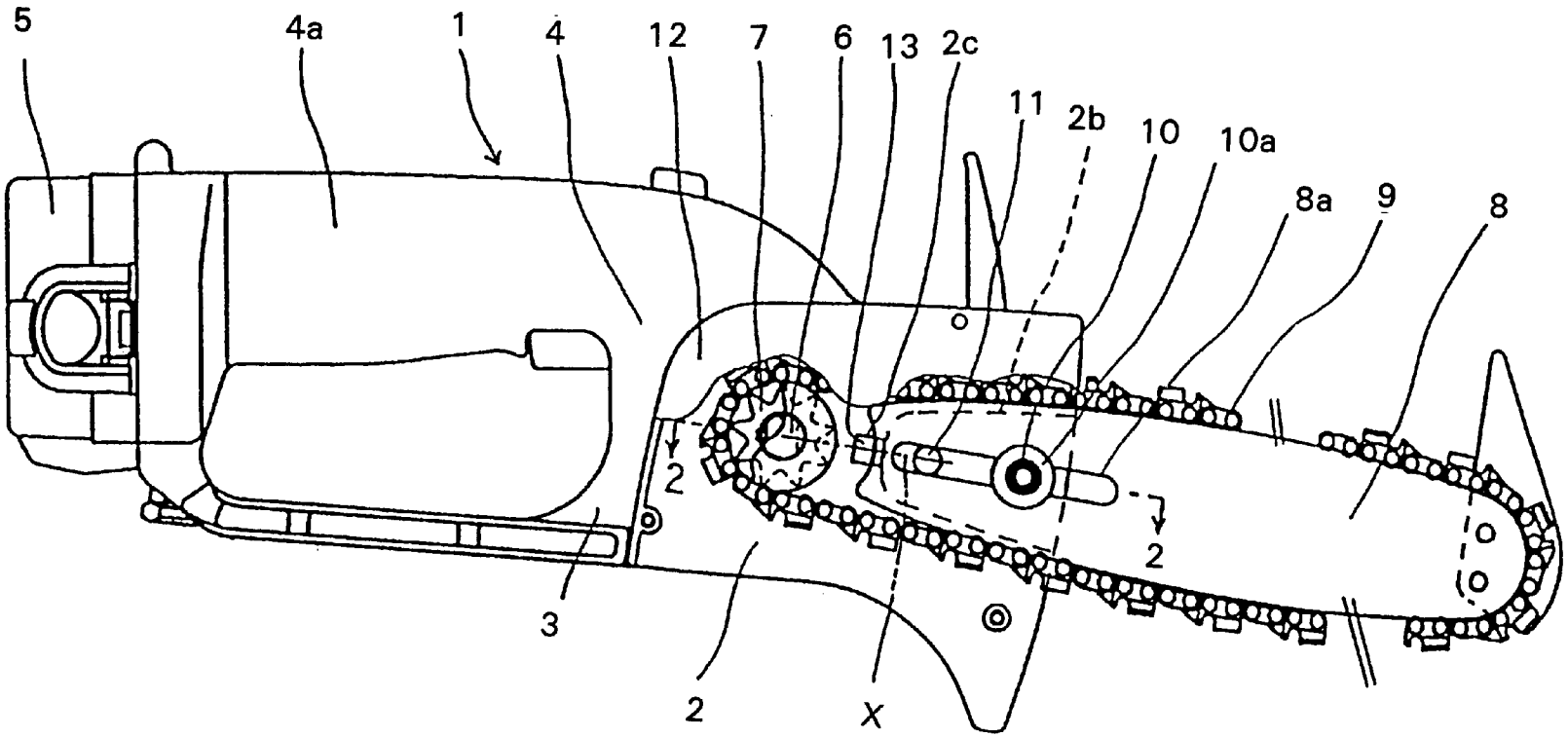
FIG. 1 is a front view of a chain saw embodying the present invention.

An embodiment of the present invention is now described based on FIGS. 1–5. FIG. 1 is a front view showing the entire structure of a chain saw 1 embodying the invention. As shown in FIG. 1, a chain saw body 4 comprises gear housing 2 and a motor housing 3, and a battery 5 is attached to the rear of a handle 4*a* of the chain saw body 4. A motor (not shown) is contained in the motor housing 3, and the rotary drive force of the motor is transmitted to a sprocket 7 fixed on a spindle 6. A chain 9 is wound around an outer periphery of a guide bar 8, and driven or rotated by the sprocket 7. An elongate guide elongated hole 8*a* is formed a rear middle portion of the guide bar 8. An attachment bolt 10 is inserted, via a washer 10*a,* through the elongate guide hole 8*a*. By screwing the attachment bolt 10 into a threaded hole 2*a,* formed in the gear housing 2, the guide bar 8 is fixed to the chain saw body 4, while a rear side surface of the guide bar 8 abuts against an abutment face 2*b* partially protruded from the gear housing 2. A tip of a guide pin 11, fixed to the gear housing 2, is inserted into the elongate guide hole 8*a* of the guide bar 8, and the guide bar 8 is guided in the longitudinal direction by the tip of the guide pin 11. Additionally, a cover 12 is provided for covering a rear side of the sprocket 7 and the guide bar 8.

Figure 2:
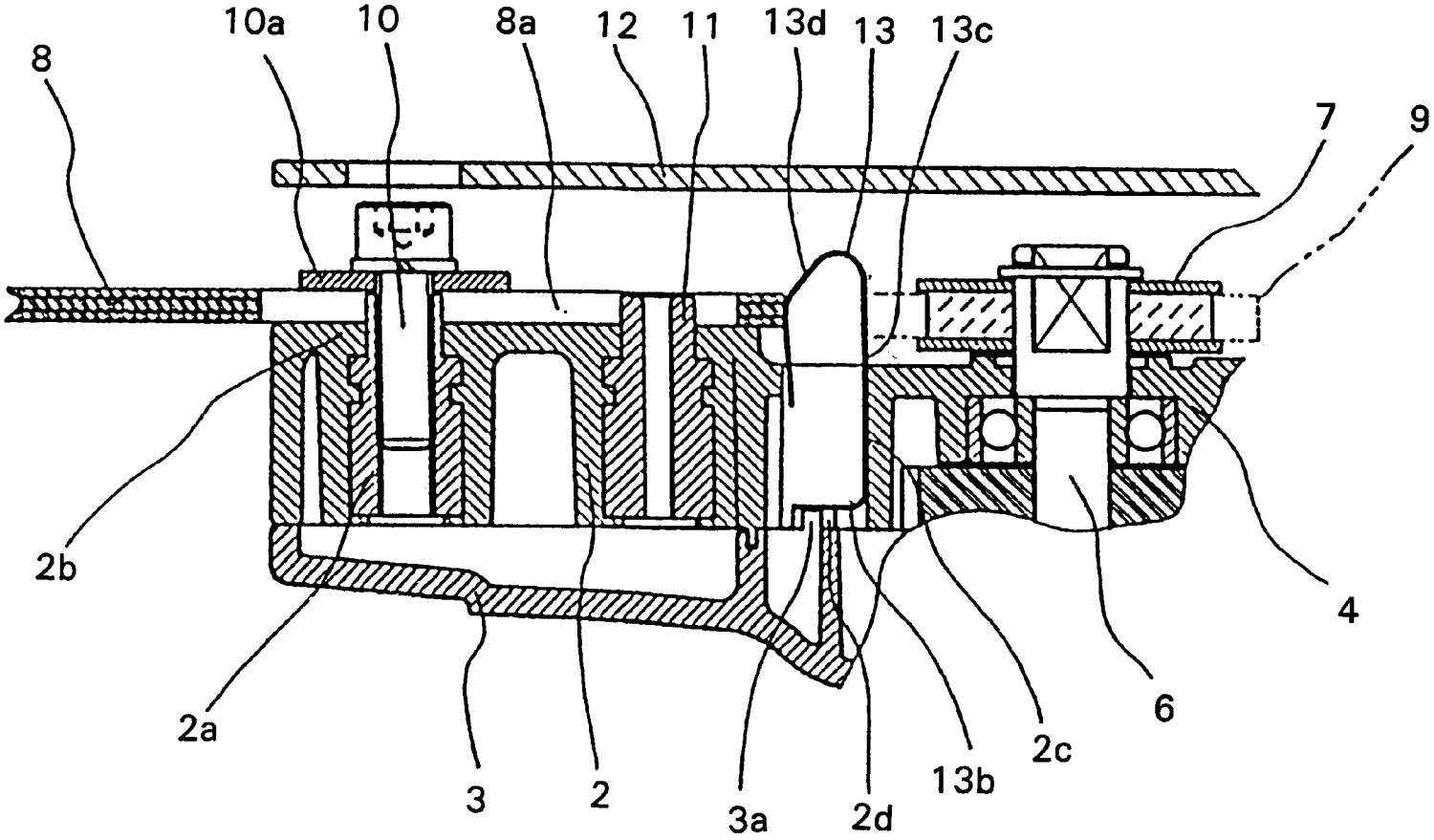
FIG. 2 is an enlarged view of the chain saw taken along a line 2—2 of FIG. 1.
Figure 3:
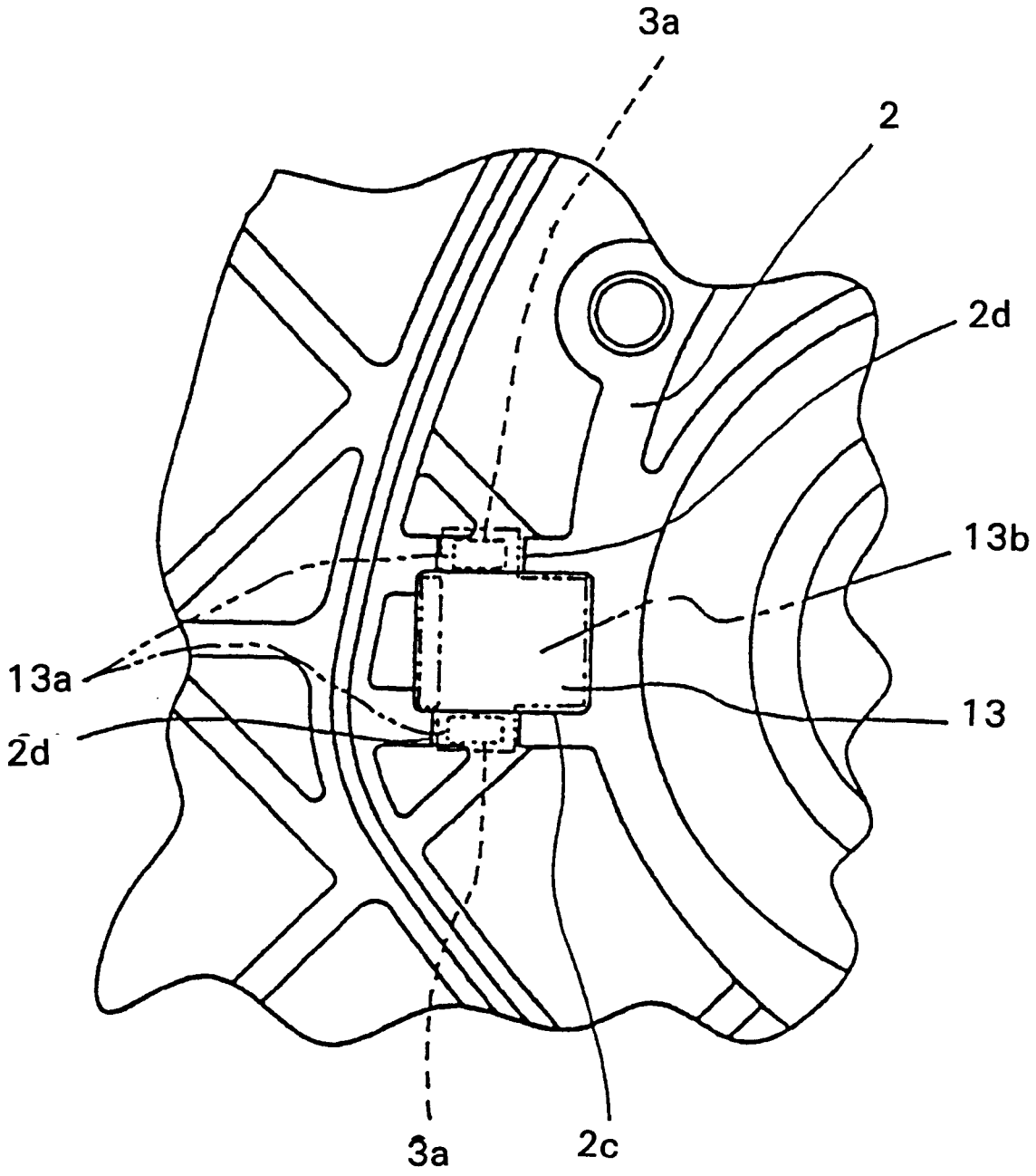
FIG. 3 is an enlarged view showing a spring leaf insertion hole formed in the rear side of a gear housing shown in FIG. 1.
Figure 4:
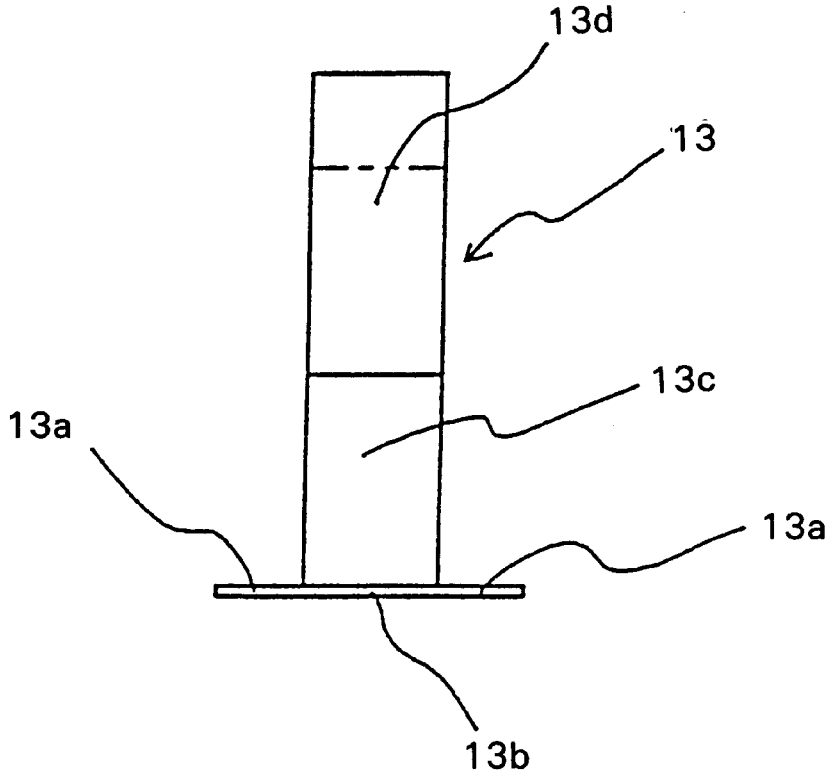
FIG. 4 is an enlarged front view of a leaf spring shown in FIG. 1.
Figure 5:
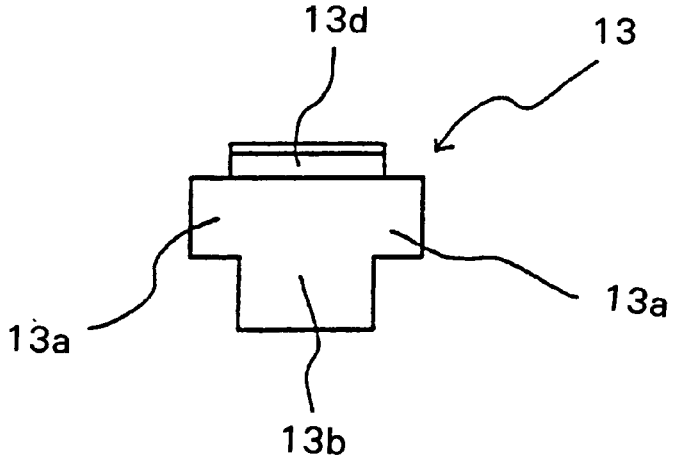
FIG. 5 is an enlarged bottom view of the leaf spring shown in FIG. 1.

A chain tension device, for adjusting the tension of the chain 9, is now described. As shown in FIGS. 2 and 3, a leaf spring insertion hole 2*c* is formed of a substantially square shape in the vicinity of a rear end of the guide bar 8 in the gear housing 2, and a leaf spring 13, formed of a bent flat plate, is inserted in the leaf spring insertion hole 2*c*. As shown in FIGS. 2, 4 and 5, the leaf spring 13 comprises of a bottom portion 13*b* having engaging protrusions 13*a* extended from opposite sides of the bottom portion 13*b,* a vertical portion 13*c* extended substantially perpendicularly to the bottom portion 13*b,* and a curved portion 13*d* bent in a substantially U-shape toward the bottom portion 13*b*. The gear housing 2 has an engagement recess 2*d* in a rear surface thereof. The engaging protrusions 13*a* of the leaf spring 13 are engaged in the engagement recess 2*d,* so that the leaf spring 13 is prevented from dropping off, or being removed in a direction toward the guide bar 8. On the other hand, on the side of the gear housing 2 of the motor housing 3, protrusions 3*a* shaped like substantially square poles are formed opposite to the engagement recess 2*d* for engagement in the engagement recess 2*d*. When the motor housing 3 is assembled with the gear housing 2, as shown in FIG. 3, the protrusions 3*a* hold the engaging protrusions 13*a* in the engagement recess 2*d,* and the leaf spring 13 is, therefore, fixed to the chain saw body 4. The portion of the vertical portion 13*c* of the leaf spring 13, adjacent the bottom portion 13*b,* abuts against a side wall of the leaf spring insertion hole 2*c* on the side of the sprocket 7, and the portion of the vertical portion 13*c* adjacent the curved portion 13*d* is extended together with the curved portion 13*d* out of the leaf spring insertion hole 2*c* of the gear housing 2 toward the guide bar 8. Since the outer periphery of the curved portion 13*d* adjacent the guide bar 8 abuts against substantially the middle portion of the rear end of the guide bar 8, the guide bar 8 is usually biased by the resilience of the leaf spring 13 outwardly in the longitudinal direction, i.e. in the tensioning direction of the chain 9.

Operation of the chain tension device having the aforementioned construction for adjusting the tension of the chain 9 is described. First, the attachment bolt 10 is slightly loosened. By loosening the attachment bolt 10, the guide bar 8 is released from its fixed condition with the gear housing 2. The guide bar 8 is moved, by the biasing force of the leaf spring 13, in the tensioning direction of the chain 9, until the tension of the chain 9 reaches the optimum condition. In this condition, by tightening the attachment bolt 10, the guide bar 8 is again fixed to the gear housing 2. In this manner, the tension of the chain 9 can be appropriately adjusted. When the chain saw 1 is operated for a long period of time, the chain 9 gradually becomes loosened. In the embodiment, simply by slightly loosening and tightening the attachment bolt 10, the tension of the chain 9 can be easily and appropriately corrected or adjusted.

In the embodiment the battery 5 is used as a motor drive source. If an operator excessively tightens the chain 9 by mistake with the tension device, the battery 5 runs out of power over a short period, the operation time of the chain saw 1 is shortened, and the operation efficiency of the chain saw 1 is decreased. In the embodiment, however, the tension of the chain 9 is maintained constant by the biasing force of the leaf spring 13. Therefore, the chain 9 is advantageously prevented from having an excessive tension or inappropriate tension.

Further in the embodiment, simply by inserting the leaf spring 13 into the leaf spring insertion hole 2*c* of the gear housing 2, the leaf spring 13 is fixed to the chain saw body 4. The tension device of the chain 9 can be easily attached to the chain saw body 4. Also, the leaf spring 13 abuts against the substantially middle of the rear end of the guide bar 8, and the abutment portion is substantially positioned along a line connecting the center of the sprocket 7 and the longitudinal central axis of the guide elongated hole 8*a*, shown by an imaginary line in FIG. 1. The guide bar 8 can be securely moved in the longitudinal direction without causing vertical dislocation, and the tension of the chain 9 can be appropriately adjusted.

According to the tension device of the chain for use in the chain saw, different from the prior art, no driver or any other tool is required for adjustment of the chain tension. The tension of the chain can be appropriately adjusted. The tension device of the invention has a simple and compact structure and can be easily mounted on the chain saw.

While the invention has been described with reference to a preferred embodiment, it is to be understood that modifications or variation may be easily made without departing from the sprit of this invention which is defined by the appended claims.

What is claimed is:

1. A chain saw, having a chain tension device for tensioning a cutting chain comprising:

a guide bar having an outer periphery for guiding a cutting chain therearound;

a sprocket for driving the cutting chain, and said sprocket being driven by a drive mechanism;

the cutting chain wrapped around said sprocket and said outer periphery of said guide bar for rotation therearound;

a chain saw body supporting said guide bar, said sprocket and said drive mechanism and including a leaf spring insertion hole formed in the chain saw body and situated between said guide bar and said sprocket; and a leaf spring interposed between an end of said guide bar adjacent said sprocket and said sprocket, said leaf spring, being captively supported and housed within the leaf spring insertion hole, resiliently and directly engaging said chain saw body and said guide bar end to bias said guide bar in a longitudinal direction of said guide bar, away from said sprocket, thereby applying a desired tension to said cutting chain.

2. The chain saw according to claim 1, wherein said leaf spring abuts against a rearwardly facing middle end portion of said guide bar located adjacent said sprocket.

3. The chain saw according to claim 1, wherein said guide bar further comprises an elongate guide hole which extends along said longitudinal direction and is located adjacent the adjacent end portion of said guide bar supported by said chain saw body;

an attachment bolt extends through said elongate guide hole for securing said guide bar to said chain saw body, and said attachment bolt has a tightened position and a loosened position; and a guide pin is located between said attachment bolt and said sprocket, and said guide pin also extends through said elongate guide hole such that when said attachment bolt is loosened, said guide bar is slidable along said longitudinal direction and when said bolt is tightened said guide bar is secured in a fixed relationship relative to said chain saw body via said guide pin and said attachment bolt.

4. The chain saw according to claim 3, wherein said guide pin and said attachment bolt cooperate with one another to allow said guide bar to move only longitudinally along said longitudinal direction.

5. The chain saw according to claim 1, wherein said leaf spring further comprises:

a first arm resiliently opposed and substantially parallel with a second arm extending transversely of said guide bar from said leaf spring insertion hole;

a bottom portion extending from said first arm within said leaf spring insertion hole and having a plurality of protrusions for engaging said leaf spring insertion hole; and a curved U-shaped portion joining said first and second arms which extends outwardly from said leaf spring insertion hole, said first arm being in contact with said chain saw body and the curved U-shaped portion arching generally back toward said bottom portion to form said second arm which is in direct contact with said guide bar.

6. The chain saw according to claim 5, wherein said leaf spring insertion hole further comprises a plurality of engagement recesses which mate with said engaging protrusions of said bottom portion for removably securing said leaf spring within said insertion hole.

7. A chain saw having a chain tension device for tensioning a cutting chain, comprising:

a guide bar having a longitudinal axis and an outer periphery for guiding a cutting chain therearound;

a sprocket for driving a cutting, and said sprocket being driven by a drive mechanism;

a chain saw body supporting said guide bar, said sprocket and said drive mechanism;

a cutting chain wrapped around said sprocket and said outer periphery of said guide bar for rotation therearound;

a leaf spring interposed between an end of said guide bar adjacent said sprocket and said sprocket, a first portion of said leaf spring directly abutting and biasing said end of the guide bar in a longitudinal direction along the longitudinal axis, of said guide bar, away from said sprocket thereby applying a desired tension to said cutting chain; and a second portion of said leaf spring being captively supported and housed within a leaf spring insertion hole defined by and located in said chain saw body, said leaf spring partially extending from said leaf spring insertion hole transversely of said guide bar longitudinal axis and engaging said adjacent end of the guide bar for applying a desired cutting chain tension.

8. The chain saw according to claim 7, wherein said leaf spring abuts against a rearwardly facing middle end portion of said guide bar located adjacent said sprocket.

9. The chain saw according to claim 7, wherein said guide bar further comprises an elongate guide hole which extends along said longitudinal direction and is located adjacent the adjacent end portion of said guide bar supported by said chain saw body;

an attachment bolt extends through said elongate guide hole for securing said guide bar to said chain saw body, and said attachment bolt has a tightened position and a loosened position; and a guide pin is located between said attachment bolt and said sprocket, and said guide pin also extends through said elongate guide hole such that when said attachment bolt is loosened, said guide bar is slidable along said longitudinal direction and when said bolt is tightened said guide bar is secured in a fixed relationship relative to said chain saw body via said guide pin and said attachment bolt.

10. The chain saw according to claim 9, wherein said guide pin and said attachment bolt cooperate with one another to allow said guide bar to move only longitudinally along said longitudinal direction.

11. The chain saw according to claim 7, wherein said leaf spring further comprises:

a bottom portion having a plurality of protrusions for engaging with said leaf spring insertion hole;

a vertical portion which extends substantially perpendicularly to said bottom portion and forms said first parallel opposed arm; and a curved U-shaped portion which extends from said vertical portion arching generally back toward said bottom portion to form said second parallel opposed arm.

12. The chain saw according to claim 1, wherein the leaf spring insertion hole further comprises a plurality of engagement recesses which mate with said engaging protrusions of said bottom portion for removably securing said leaf spring within said insertion hole.

13. A chain saw having a chain tension device for tensioning a cutting chain, the chain saw comprising:

an adjustable guide bar having an outer periphery for guiding a cutting chain therearound;

a sprocket for driving the cutting chain about the outer periphery of the guide bar, and said sprocket being driven by a drive mechanism;

the cutting chain wrapped around said sprocket and said outer periphery of said guide bar for rotation therearound;

a chain saw body supporting said guide bar, said sprocket and said drive mechanism and including a leaf spring insertion hole formed in the chain saw body, the leaf spring insertion hole extending substantially perpendicular to a plane defined by said guide bar; and a second arm portion of the leaf spring interposed between an end of said guide bar, located adjacent said sprocket, and a first arm portion of said leaf spring being captively supported and at least partially housed within the leaf spring insertion hole, the second arm portion resiliently and directly engaging with the end of said guide bar, located adjacent said sprocket, to bias said guide bar longitudinal away from said sprocket thereby applying a desired tension to said cutting chain.

14. The chain saw according to claim 13, wherein said leaf spring comprises a U-shaped leaf spring, the first and the second arm portions are substantially parallel to one another and said first arm portion engages with a surface of said leaf spring insertion hole and said second arm portions contacts with the end of said guide bar, located adjacent said sprocket.

15. The chain saw according to claim 13, wherein, wherein said leaf spring further comprises a bottom portion extending from said first arm within said leaf spring insertion hole and having a plurality of protrusions for engaging said leaf spring insertion hole; and a curved U-shaped portion joining said first and second arm portions which extends outwardly from said leaf spring insertion hole, said first arm being in contact with said chain saw body and the curved U-shaped portion arching generally back toward said bottom portion to form said second arm which is in direct contact with said guide bar.

16. The chain saw according to claim 15, wherein said leaf spring insertion hole further comprises a plurality of engagement recesses which mate with said engaging protrusions of said bottom portion for removably securing said leaf spring within said insertion hole.

* * * * *